US012571392B2

(12) United States Patent
Zhuge et al.

(10) Patent No.: US 12,571,392 B2
(45) Date of Patent: Mar. 10, 2026

(54) DUAL-MODE COMPRESSOR

(71) Applicants: TSINGHUA UNIVERSITY, Beijing (CN); BEIJING INSTITUTE OF TECHNOLOGY, Beijing (CN)

(72) Inventors: Weilin Zhuge, Beijing (CN); Panpan Song, Beijing (CN); Zimu Yang, Beijing (CN); Hongsheng Jiang, Beijing (CN); Yuping Qian, Beijing (CN); Yangjun Zhang, Beijing (CN)

(73) Assignees: TSINGHUA UNIVERSITY, Beijing (CN); BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 18/978,776

(22) Filed: Dec. 12, 2024

(65) Prior Publication Data

US 2025/0137460 A1 May 1, 2025

Related U.S. Application Data

(63) Continuation of application No. PCT/CN2023/082874, filed on Mar. 21, 2023.

(30) Foreign Application Priority Data

Jun. 24, 2022 (CN) ..... 202210729625.6

(51) Int. Cl.
*F04C 23/00* (2006.01)
*F04B 41/06* (2006.01)
(Continued)

(52) U.S. Cl.
CPC ..... *F04C 23/005* (2013.01); *F04B 41/06* (2013.01); *F04B 49/007* (2013.01);
(Continued)

(58) Field of Classification Search
CPC .... F04B 41/06; F04C 18/0207; F04C 18/023; F04C 18/0253; F04C 23/005; F04D 17/10; F04D 25/16
(Continued)

(56) References Cited

U.S. PATENT DOCUMENTS 4,568,256 A * 2/1986 Blain ..... F04C 29/026 418/94
5,417,554 A * 5/1995 Kietzman ..... F04C 29/04 418/101
(Continued)

FOREIGN PATENT DOCUMENTS

CN 209414144 U * 9/2019
EP 2980409 A1 * 2/2016 ..... F04C 18/0215

OTHER PUBLICATIONS

Translation of CN-209414144-U (Year: 2019).*

*Primary Examiner* — Charles G Freay
(74) *Attorney, Agent, or Firm* — JC ONE WORLD

(57) ABSTRACT

Provided is a dual-mode compressor. The dual-mode compressor includes a first scroll plate (31), a second scroll plate (32), and an impeller (33). The first scroll plate (31) and the second scroll plate (32) define a scroll compression working cavity (3*a*), and the impeller (33) defines a centrifugal compression flow channel (33*d*). The impeller (33) and the second scroll plate (32) are fixed relative to each other and are arranged coaxially, and the inlet of the centrifugal compression flow channels (33*d*) is communicated with the outlet of the scroll compression working cavity (3*a*). When the dual-mode compressor works in different models, working medium leaving the scroll compression working cavity (3*a*) can enter the centrifugal compression flow channel (33*d*) and then flow out of the dual-mode compressor or directly flow out of the dual-mode compressor.

20 Claims, 6 Drawing Sheets

(51) Int. Cl.

| | |
|---|---|
| ***F04B 49/00*** | (2006.01) |
| ***F04C 18/02*** | (2006.01) |
| ***F04D 17/10*** | (2006.01) |
| ***F04D 25/16*** | (2006.01) |

(52) U.S. Cl.
CPC ..... *F04C 18/0207* (2013.01); *F04C 18/023* (2013.01); *F04C 18/0253* (2013.01); *F04D 17/10* (2013.01); *F04D 25/16* (2013.01)

(58) Field of Classification Search
USPC ..... 417/201, 205
See application file for complete search history.

(56) References Cited

U.S. PATENT DOCUMENTS

| | | | | |
|---|---|---|---|---|
| 5,947,694 | A * | 9/1999 | Hablanian | F04C 25/02 418/5 |
| 2020/0018313 | A1* | 1/2020 | Sato | F04C 18/0215 |

* cited by examiner

DUAL-MODE COMPRESSOR

CROSS-REFERENCE TO RELATED APPLICATIONS

The present application claims priority to International Application No. PCT/CN2023/082874 filed on Mar. 21, 2023, which claims priority to Chinese Patent Application No. 202210729625.6, filed on Jun. 24, 2022. The disclosures of these applications are hereby incorporated by reference in their entirety.

TECHNICAL FIELD

The disclosure relates to the field of compressors, in particular to a dual-mode compressor.

BACKGROUND

There are mainly two types of compressors used for pressurizing or transporting fluid working medium, namely, displacement compressor and dynamic compressor. For the displacement compressor, the pressure of the working medium is increased by compressing it via changing the volume of a working cavity. For the dynamic compressor, the pressure of the working medium is increased by working on it via rotating blades.

The displacement compressor has the advantages of high compression efficiency, wide flow range, the ability to compress gas-liquid mixed working medium, and the like. However, when working under high compression ratio, the working medium is prone to leak from gaps in structures forming a working cavity due to the large pressure difference between the outlet and inlet of the working cavity, resulting in the reduction of compression efficiency. In addition, the displacement compressor has large flow loss and low efficiency at large flow condition.

The dynamic compressor has the advantages of high efficiency and the like under high compression ratio and large flow. However, it is not suitable for compressing gas-liquid mixed working medium due to the damage of rotating blades caused by droplets. In addition, blade channels of the dynamic compressor are prone to cause flow separation under low flow condition, resulting in unstable operation.

SUMMARY

The disclosure is made because of the state of the art described above. The object of the disclosure is to provide a dual-mode compressor that overcomes at least one of the disadvantages mentioned in the background above.

To achieve the above object, the following technical solutions are provided in this disclosure.

Provided is a dual-mode compressor. The dual-mode compressor includes: a first scroll plate including a first scroll wrap extending spirally around a rotation axis of the first scroll plate, a second scroll plate including a second scroll wrap extending spirally around a rotation axis of the second scroll plate, in which the second scroll wrap and the first scroll wrap define a working cavity centrifugal compression flow channels, and the rotation axis of the second scroll plate is parallel to and staggered with the rotation axis of the first scroll plate; and an impeller including a plurality of blades, in which adjacent blades in a circumferential direction of the impeller define a centrifugal compression flow channel, the impeller is fixed and coaxially arranged relative to the second scroll plate, the inlet of the centrifugal compression flow channel is communicated with the outlet of the working cavity for scroll compression, and working medium leaving the working cavity for scroll compression is capable of entering the centrifugal compression flow channel and then flowing out of the dual-mode compressor or directly flowing out of the dual-mode compressor.

In an optional embodiment, the dual-mode compressor further includes a first output flow channel that is controllably communicated with the outlet of the centrifugal compression flow channel and an outside of the dual-mode compressor.

In another optional embodiment, the first output flow channel is located at the radial outside of the impeller and includes a diffuser section and a diversion section that are communicated with each other. The diffuser section extends along a radial direction of the impeller and is communicated with the outlet of the centrifugal compression flow channel. The diversion section extends spirally around the rotation axis of the impeller.

In another optional embodiment, the dual-mode compressor further includes a second output flow channel that is controllably communicated with the outlet of the working cavity for scroll compression and outside of the dual-mode compressor.

In another optional embodiment, the dual-mode compressor further includes an input flow channel that is communicated with an inlet of the working cavity for scroll compression and outside of the dual-mode compressor.

In another optional embodiment, the second scroll plate is formed in one piece with the impeller.

In another optional embodiment, each of the blades extends continuously from a central portion of the second scroll plate to a peripheral surface of the second scroll plate. Each of the centrifugal compression flow channels is formed as being gradually expanding from the center portion of the second scroll plate toward the peripheral surface of the second scroll plate.

In another optional embodiment, the dual-mode compressor further includes a transmission member. The transmission member includes a first shaft portion and a second shaft portion that are fixed to each other. A central axis of the first shaft portion is parallel to and staggered with a central axis of the second shaft portion, and a distance between the central axis of the first shaft portion and the central axis of the second shaft portion is equal to a distance between the rotation axis of the first scroll plate and the rotation axis of the second scroll plate. The first scroll plate is provided with a first transmission hole extending along an axial direction of the first scroll plate. The first shaft portion extends into the first transmission hole. The second scroll plate is provided with a second transmission hole extending along an axial direction of the second scroll plate. The second shaft portion extends into the second transmission hole.

In another optional embodiment, a number of the transmission member is more than one. A plurality of first transmission hole are arranged uniformly along a circumferential direction of the first scroll plate, and a plurality of second transmission holes are arranged uniformly along a circumferential direction of the second scroll plate.

In another optional embodiment, the first shaft portion is in clearance fit with the first transmission hole, and the second shaft portion is in clearance fit with the second transmission hole.

By the above technical solution, the dual-mode compressor can combine the structure of the displacement compressor with the structure of the dynamic compressor through a compact structural manner. The dual-mode compressor has simple structure and small size, making it suitable for various applications with limited installation space. In addition, the dual-mode compressor is able to be in different modes to adapt to different working conditions, so that the dual-mode compressor has better adaptability and higher efficiency.

LIST OF REFERENCE SYMBOLS

1, shell assembly; 11, volute; 11*a*, input flow channel; 11*b*, first output flow channel; 11*c*, diffuser section; 11*d*, diversion section; 11*e*, first sealing teeth; 12, bearing housing; 13, cover plate; 14, end cover; 14*a*, second sealing teeth; 14*b*, exhaust hole;

2, transmission assembly; 21, rotating shaft; 22 first bearing;

3, compression assembly; 31, first scroll plate; 31*a*, first scroll wrap; 31*b*, first transmission hole; 32, second scroll plate; 32*a*, second scroll wrap; 32*b*, first communication hole; 32*c*, second transmission hole; 32*d*, third sealing teeth; 33, impeller; 33*a*, blades; 33*b*, second communication hole; 33*c*, fourth sealing teeth; 33*d*, centrifugal compression flow channel; 34, transmission member; 34*a*, first shaft portion; 34*b*, second shaft portion; 34*c*, connecting portion; 35, second bearing; 3*a*, scroll compression working cavity.

DETAILED DESCRIPTION

Exemplary embodiments of the disclosure are described below with reference to the drawings. It should be understood that these specific descriptions are only used to teach those skilled in the art how to implement the disclosure, and are not intended to exhaust all possible ways of the disclosure, nor are they intended to limit the scope of the disclosure.

FIG. 1 to FIG. 6 illustrate a dual-mode compressor according to one embodiment of the disclosure, which is particularly suitable for systems or devices such as supercritical carbon dioxide power cycle systems, internal combustion engines, micro gas turbines, fuel cell systems, heat pump air conditioners, and the like. The dual-mode compressor may include a housing assembly 1, a transmission assembly 2, and a compression assembly 3.

Figure 1:
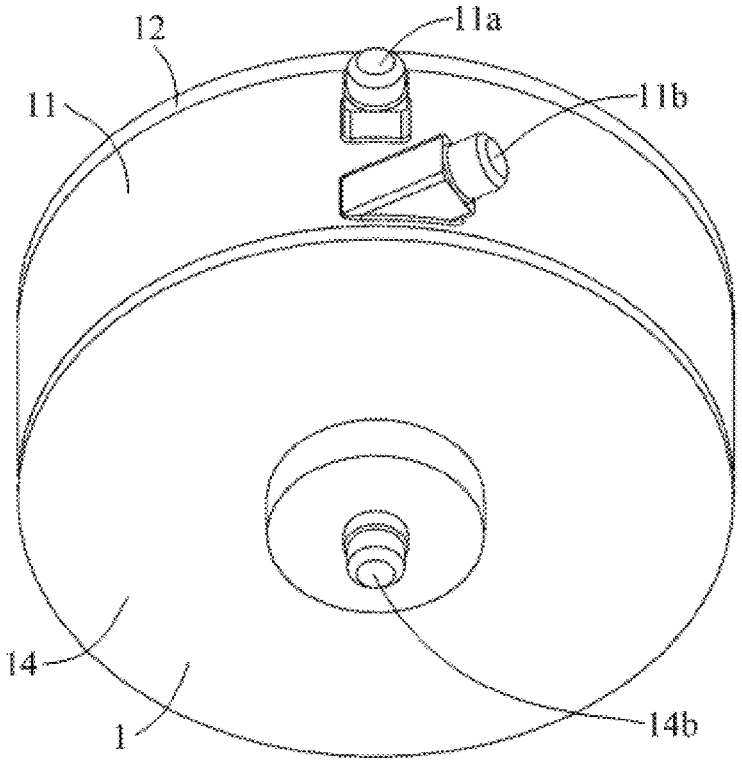
FIG. 1 shows a perspective view of a dual-mode compressor according to an embodiment of the disclosure.
Figure 2:
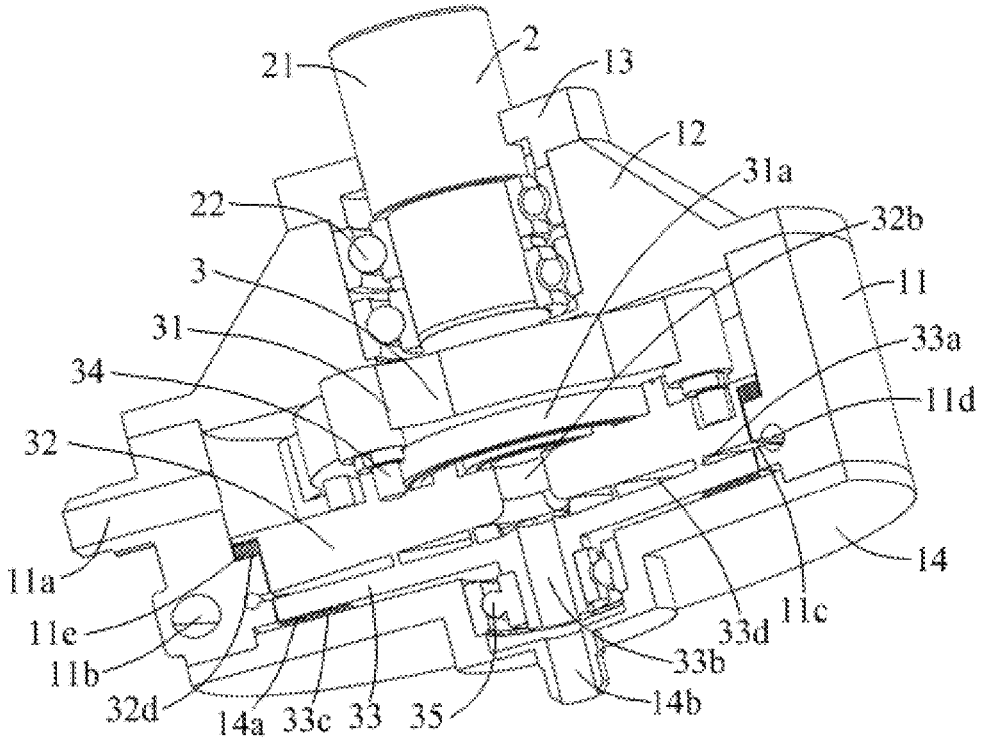
FIG. 2 shows a perspective view of the dual-mode compressor in FIG. 1, in which part of the structure is shown in a sectional manner and the section line is omitted.

Referring to FIG. 1 and FIG. 2, the housing assembly 1 may include a volute 11, a bearing housing 12, a cover plate 13, and an end cover 14. Specifically, the volute 11 may be cylindrical and enclose an internal space with the bearing housing 12, the cover plate 13 and the end cover 14. The wall of the volute 11 may be provided with an input flow channel 11*a* and a first output flow channel 11*b*. The input flow channel 11*a* and the first output flow channel 11*b* may be controllably communicated with the outside of the volute 11 and the internal space. The user can control the opening and closing states of the input flow channel 11*a* and the first output flow channel 11*b*. The input flow channel 11*a* may extend along the radial direction of the volute 11. The first output flow channel 11*b* includes a diffuser section 11*c* and a diversion section 11*d*. The diffuser section 11*c* may extend along the radial direction of the volute 11 and is communicated with the internal space throughout the circumference. The diversion section 11*d* may be located at the radial outside of the diffuser section 11*c* and extends spirally and continuously around the rotation axis of the impeller 33. The cross-section of at least a part of the diffuser section 11*d* gradually increases with the extension. The inner surface of a portion of the volute 11 facing the second scroll plate 32 is provided with a plurality of first sealing teeth 11*e*. An end surface of the end cover 14 facing the impeller 33 is provided with a plurality of second sealing teeth 14*a* (in this embodiment, an end surface is referred to as axial end surfaces). The central portion of the end cover 14 may be provided with an exhaust hole 14*b* penetrating along the central axis of the end cover 14. The bearing housing 12 and the cover plate 13 may be mounted at one end of the volute 11, and the end over 14 may be mounted at the other end of the volute 11.

Referring to FIG. 2, the transmission assembly 2 may include a rotating shaft 21 and first bearings 22. Specifically, two first bearings 22 may be coaxially sleeved on the rotating shaft 21, and the bearing housing 12 may be sleeved on the first bearings 22. The cover plate 13 may be mounted at the end of the bearing housing 12. The outer ring of the first bearing 22 abuts against the boss portion of the bearing housing 12 and the cover plate 13 in the axial direction, so that the first bearing 22 is confined in the bearing housing 12 by the cover plate 13.

Referring to FIG. 2 to FIG. 5, the compression assembly 3 may include a first scroll plate 31, a second scroll plate 32, an impeller 33, a transmission member 34 and a second bearing 35.

Specifically, the end surface facing the second scroll plate 32, of the first scroll plate 31 may be provided with first scroll wrap 31*a*, which may spirally and continuously extend around the rotation axis of the first scroll plate 31. The first scroll plate 31 may be provided with four first transmission holes 31*b*, which may be arranged outside the first scroll wrap 31*a* and uniformly along the circumferential direction of the first scroll plate 31. The first scroll plate 31 may be coaxially arranged with and fixed to the rotating shaft 21, so that the first scroll plate 31 can rotate integrally with the rotating shaft 21. The central axis of the first scroll plate 31 is coincident with the rotation axis of the first scroll plate 31.

Figure 3:
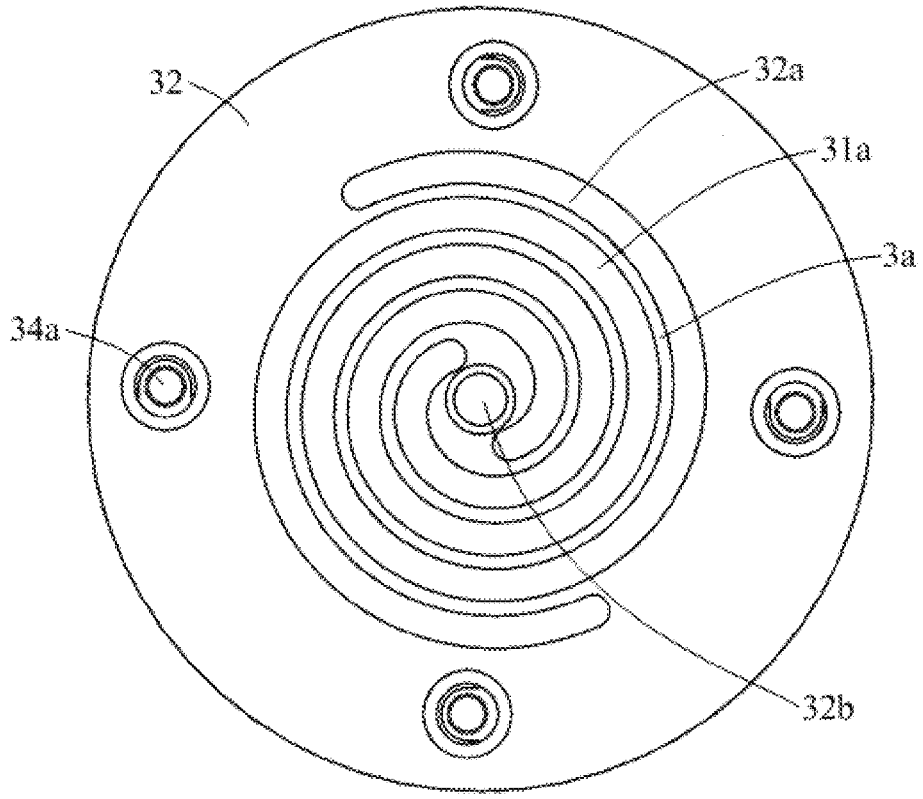
FIG. 3 shows a schematic view of a scroll compression working cavity of the dual-mode compressor in FIG. 1.

The end surface facing the first scroll plate 31, of the second scroll plate 32 may be provided with second scroll wrap 32*a*, which may spirally and continuously extend around the rotation axis of the second scroll plate 32. Referring to FIG. 3, the second scroll wrap 32*a* may be nested with the first scroll wrap 31*a* to define a scroll compression working cavity 3*a* in a double helical shape between the first scroll wrap 31*a* and the second scroll wrap 32*a*. The scroll compression working cavity 3*a* may be communicated with the input flow channel 11*a* via the internal space. The second scroll plate 32 may be provided with four second transmission holes 32, which may be arranged outside the second scroll wrap 32*a* and uniformly along the circumferential direction of the second scroll plate 32. The second scroll plate 32 may be provided with a first communication hole 32*b*, which may penetrate through the second scroll plate 32 along the rotation axis of the second scroll plate 32. The first communication hole 32*b* may be communicated with the input flow channel 11*a* via the scroll compression working cavity 3*a* and the internal space. A plurality of third sealing teeth 32*d* may be provided at the periphery portion of the second scroll plate 32 and may be staggered with the plurality of first sealing teeth 11*e*, such that the second scroll plate 32 is labyrinth-sealed with the volute 11. The central axis of the second scroll plate 32 is coincident with the rotation axis of the second scroll plate 32.

Figure 4:
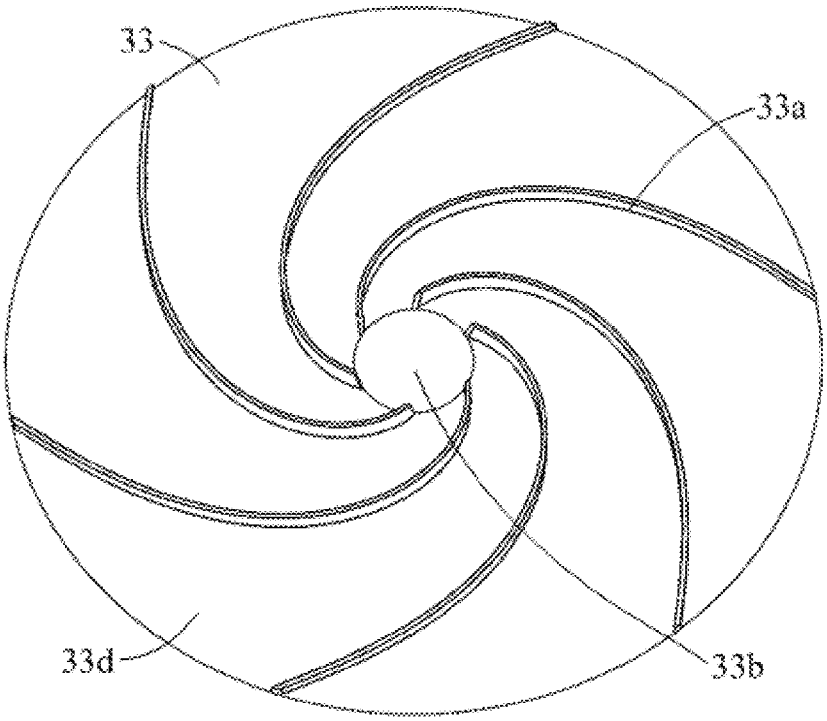
FIG. 4 shows a schematic view of centrifugal compression flow channels of the dual-mode compressor in FIG. 1.

Referring to FIG. 4, the end surface of the impeller 33 may be provided with a plurality of blades 33*a*, which may extend continuously from the central portion of the impeller 33 to the peripheral surface of the impeller 33, e.g., in the shape of a Bessel curve. The plurality of blades 33*a* may be uniformly arranged and spaced apart from each other in the circumferential direction of the impeller 33. A centrifugal compression flow channel 33*d* gradually expanding from the inlet toward the outlet may be formed between adjacent blades 33*a*. The inlet of the centrifugal compression flow channel 33*d* may be located at the central portion of the impeller 33, and the outlet of the centrifugal compression flow channel 33*d* may be located at the peripheral surface of the impeller 33 and aligned with the diffuser section 11*c*. The impeller 33 may be arranged coaxially with the second scroll plate 32 and formed in one piece with the second scroll plate 32, such that the first communication hole 32*b* may communicate the outlet of the scroll compression working cavity 3*a* and the inlet of the centrifugal compression flow channels 33*d*. The impeller 33 may be provided with a second communication hole 33*b*, which may penetrate through the impeller 33 along the rotation axis of the impeller 33. The second communication hole 33*b* may be aligned with the exhaust hole 14*b*, such that the second communication hole 33*b* and the exhaust hole 14*b* form a second output flow channel. The second output flow channel may controllably communicate with the inlet of the centrifugal compression flow channels 33*d* and the outside of the dual-mode compressor. A user may control the opening and closing states of the second output flow channel. The outlet of the scroll compression working cavity 3*a* may controllably communicate with the outside of the dual-mode compressor via the first communication hole 32*b* and the second output flow channel. The surface of impeller 33 may be provided with a plurality of fourth sealing teeth 33*c*. The plurality of fourth sealing teeth 33*c* may be staggered with the plurality of second sealing teeth 14*a*, such that the second scroll plate 33 is labyrinth-sealed with the end cover 14.

The second bearing 35 may be coaxially sleeved on the impeller 33, and the end cover 14 may be sleeved on the second bearing 35. The second bearing 35 may define the rotation axis of the second scroll plate 32. The rotation axis of the second scroll plate 32 may be parallel to and staggered with the rotation axis of the first scroll plate 31.

Figure 5:
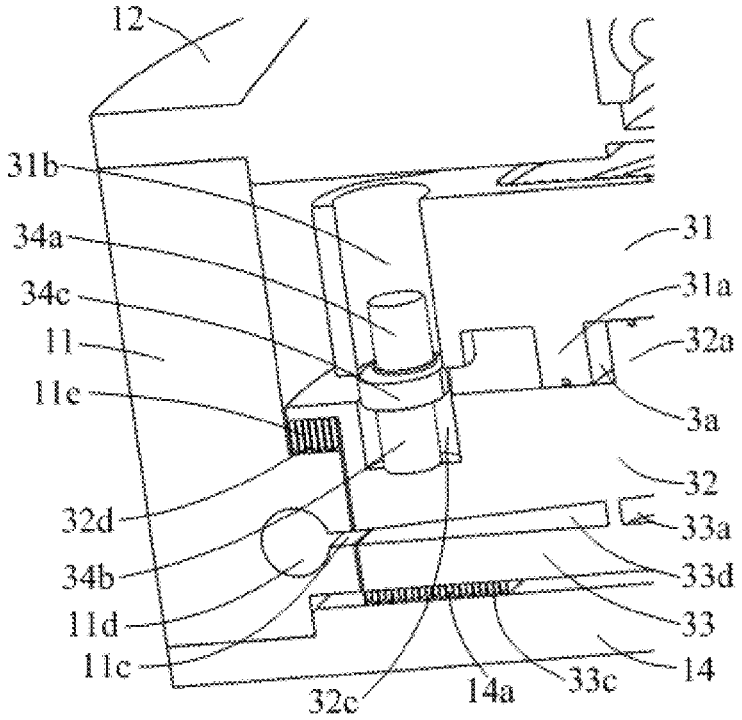
FIG. 5 shows a perspective view of the partial structure of the dual-mode compressor in FIG. 1, in which the structure of the transmission member is mainly shown.

Referring to FIG. 5, the transmission member 34 may have substantially the same shape as a crank throw. Specifically, the transmission member 34 includes a first shaft portion 34*a*, a second shaft portion 34*b* and a connecting portion 34*c*. The connecting portion 34*c* may be plate-shaped. The first shaft portion 34*a* and the second shaft portion 34*b* may extend from the connecting portion 34*c* toward both sides of the connecting portion 34*c*, respectively. A central axis of the first shaft portion 34*a* is parallel to and staggered with a central axis of the second shaft portion 34*b*. A distance (the shortest distance) between the central axis of the first shaft portion 34*a* and the central axis of the second shaft portion 34*b* may be equal to a distance between the rotation axis of the first scroll plate 31 and the rotation axis of the second scroll plate 32. The first shaft portion 34*a* may extend into the first transmission hole 31*b*, while the second shaft portion 34*b* may extend into the second transmission hole 32*c*.

Further, the first shaft portion 34*a* may be in clearance fit with the first transmission hole 31*b*, while the second shaft portion 34*b* may be in clearance fit with the second transmission hole 32*c*, so that the rotation tendency of the transmission member can be suppressed. Of course, this is not mandatory.

Figure 6:
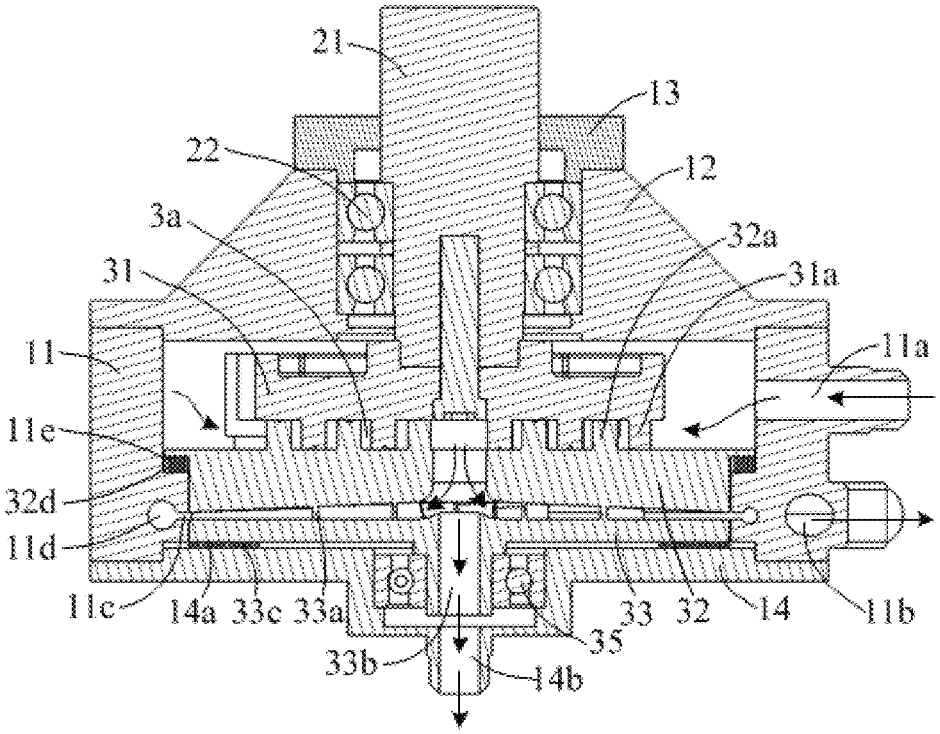
FIG. 6 shows a schematic view of the flow path of a working medium of the dual-mode compressor in FIG. 1, in which arrows indicate the flow directions of the working medium.

Referring to FIG. 6, the dual-mode compressor may have a scroll-centrifugal compression mode and a scroll mode. Specifically, when the flow rate of the working medium is large, the first output flow channel 11*b* can be opened and the second output flow channel can be closed, so that the dual-mode compressor is in the scroll-centrifugal compression mode. In this mode, the working medium can enter the internal space from the input flow channel 11*a*, and the working fluid entering the internal space can be sucked into the scroll compression working cavity 3*a*. When the rotating shaft 21 rotates, the rotating shaft 21 can directly drive the first scroll plate 31 to rotate, and the first scroll plate 31 can drive the second scroll plate 32 and the impeller 33 to rotate through the transmission member 34. Meanwhile, the second scroll plate 32 periodically translate relative to the first scroll plate 31, which causes the volume of the scroll compression working cavity 3*a* to change periodically, such that the working medium in the scroll compression working cavity 3*a* undergoes a first compression.

The working medium after the first compression, can be discharged from the outlet of the scroll compression working cavity 3*a* and then enter the centrifugal compression flow channels 33*d* via the first communication hole 32*b*. The working medium in the centrifugal compression flow channels 33*d* may be thrown into the diffuser section 11*c* at a higher speed under the action of centrifugal force, so that the working medium undergoes a second compression in the centrifugal compression flow channels 33*d*. Ultimately, the working medium after the two compressions, is guided away from the dual-mode compressor by the diversion section 11*d*.

In this mode, the scroll compression can be configured to have a lower compression ratio and the centrifugal compression can be configured to have a higher compression ratio. By doing so, the scroll compression working cavity 3*a* has a smaller leakage loss without losing the compression ratio of the dual-mode compressor, so that the dual-mode compressor achieves a higher efficiency. In addition, for the gas-liquid mixed working medium, the scroll compression can increase the pressure and temperature of the working medium in advance, so that the working medium does not condense when it enters the centrifugal compression flow channel 33*d*, and thus the blades 33*a* are less likely to be damaged.

When the flow rate of the working medium is relatively small, the first output flow channel 11*b* can be closed and the second output flow channel can be opened, so that the dual-mode compressor is in the scroll compression mode. In this mode, the working medium compressed in the scroll compression working cavity 3*a* can directly leave the dual-mode compressor via the second output flow channel without passing through the centrifugal compression flow channels 33*d*, so that the working medium is compressed only once. By doing so, low efficiency and instability of centrifugal compression under the condition of small flow can be avoided.

By controlling the opening and closing states of the first output flow channel 11*b* and the second output flow channel, the working medium can leave the dual-mode compressor via the first output flow channel 11*b* in the scroll-centrifugal compression mode, and can leave the dual-mode compressor via the second output flow channel in the scroll compression mode, so that the working medium leaving the scroll compression working cavity 3*a* can selectively enter the centrifugal compression flow channels 33*d*.

Furthermore, in the dual-mode compressor of the disclosure, the second scroll plate 32 is labyrinth-sealed with the volute 11, so that the input flow channel 11*a* does not directly communicate with the first output flow channel 11*b* and the second output flow channel without passing through the above-described communication path. The impeller 33 is labyrinth-sealed with the end cover 14, so that the second output flow channel does not directly communicate with the input flow channel 11*a* and the first output flow channel 11*b* without passing through the above-described communication path. In this way, the input flow path 11*a*, the first output flow path 11*b* and the second output flow path can communicate with each other according to a target path, and thus the working medium can flow along the target path.

This Disclosure has at Least the Following Advantages:

(i) By coupling scroll compression and centrifugal compression, the dual-mode compressor is able to be in the scroll-centrifugal compression mode, allowing the dual-mode compressor to have high efficiency and to be used for compressing gas-liquid mixed working medium.

(ii) By providing the second output flow channel, the dual-mode compressor is able to be in the scroll compression mode, allowing the dual-mode compressor to adapt to low flow conditions.

(iii) By providing the transmission member 34, the second scroll plate 32 is able to be driven by the first scroll plate 31, so that the first scroll plate 31, the second scroll plate 32, and the impeller 33 can be driven by the same driving source, thereby making the driving structure of the dual-mode compressor simple and compact.

It should be understood that the above embodiments are merely exemplary and are not intended to limit the application. Those skilled in the art may make various variations and changes to the above embodiments under the teachings of the application without departing from the scope of the application. Supplementary descriptions are provided below.

It should be understood that the second scroll plate 32 is not limited to being driven by the first scroll plate 31 via the transmission member 34. For example, the second scroll plate 32 may be driven by the first scroll plate 31 via a gear. The second scroll plate 32 is not limited to being driven by the first scroll plate 31. For example, the first scroll plate 31 and the second scroll plate 32 may be driven by the same drive source. The driven source may drive the first scroll plate 31 and the second scroll plate 32 through different transmission components. Alternatively, the first scroll plate 31 and the second scroll plate 32 may be driven by different drive sources.

It should be understood that the impeller 33 is not limited to being formed in one piece with the second scroll plate 32. For example, the impeller 33 and the second scroll plate 32 may be independent of each other, and the impeller 33 may be connected with the second scroll plate 32 in a torsion-proof manner. That is, the impeller 33 and the second scroll plate 32 are connected in a manner of transmitting torque. Alternatively, the impeller 33 may be secured to the second scroll plate 32 by a fastener.

It should be understood that the number of the transmission member 34 is not limited to four. For example, there may be one or more the transmission member 34.

What is claimed is:

1. A dual-mode compressor, comprising:

a first scroll plate (31) comprising a first scroll wrap (31*a*), wherein the first scroll wrap (31*a*) extends spirally around a rotation axis of the first scroll plate (31);

a second scroll plate (32) comprising a second scroll wrap (32*a*), wherein the second scroll wrap (32*a*) extends spirally around a rotation axis of the second scroll plate (32), the second scroll wrap (32*a*) and the first scroll wrap (31*a*) define a scroll compression working cavity (3*a*), and the rotation axis of the second scroll plate (32) is parallel to and staggered with the rotation axis of the first scroll plate (31); and an impeller (33) comprising a plurality of blades (33*a*), wherein the plurality of the blades (33*a*) is arranged and spaced apart from each other in the circumferential direction of the impeller (33), forming a plurality of centrifugal compression flow channels (33*d*) between adjacent blades, the impeller (33) is fixed and coaxially arranged relative to the second scroll plate (32), an inlet of the centrifugal compression flow channel (33*d*) is communicated with an outlet of the scroll compression working cavity (3*a*);

wherein the dual-mode compressor comprises two mode, one mode is that the working medium leaving the scroll compression cavity (3*a*) enters the centrifugal compression flow channels (33*d*) and then flows out of the dual-mode compressor; the other mode is that the working medium leaving the scroll compression cavity (3*a*) directly flows out of the dual-mode compressor.

2. The dual-mode compressor of claim 1, wherein the dual-mode compressor further comprises a first output flow channel (11*b*) that is communicated with the outlet of the centrifugal compression flow channel (33*d*) and an outside of the dual-mode compressor, wherein the first output flow channel (11*b*) is controlled to be opened or closed.

3. The dual-mode compressor of claim 2, wherein the first output flow channel (11*b*) is located at radially outside of the impeller (33) and comprises a diffuser section (11*c*) and a diversion section (11*d*) that are communicated with each other, the diffuser section (11*c*) extends along a radial direction of the impeller (33) and is communicated with the outlet of the centrifugal compression flow channel (33*d*), and the diversion section (11*d*) extends spirally around a rotation axis of the impeller (33).

4. The dual-mode compressor of claim 1, wherein the dual-mode compressor further comprises a second output flow channel that is communicated with an outlet of the scroll compression working cavity (3*a*) and an outside of the dual-mode compressor, wherein the second output flow channel is controlled to be opened or closed.

5. The dual-mode compressor of claim 1, wherein the dual-mode compressor further comprises an input flow channel (11*a*) that is communicated with an inlet of the scroll compression working cavity (3*a*) and an outside of the dual-mode compressor.

6. The dual-mode compressor of claim 1, wherein the second scroll plate (32) is formed in one piece with the impeller (33).

7. The dual-mode compressor of claim 1, wherein each of the blades (33*a*) extends continuously from a central portion of the second scroll plate (32) to a peripheral surface of the second scroll plate (32), and each of the plurality of the centrifugal compression flow channels (33*d*) is formed as being gradually expanding from the center portion of the second scroll plate (32) toward the peripheral surface of the second scroll plate (32).

8. The dual-mode compressor of claim 1, wherein the dual-mode compressor further comprises a transmission member (34) comprising a first shaft portion (34*a*) and a second shaft portion (34*b*) that are fixed to each other, a central axis of the first shaft portion (34*a*) is parallel to and staggered with a central axis of the second shaft portion (34*b*), and a distance between the central axis of the first shaft portion (34*a*) and the central axis of the second shaft portion (34*b*) is equal to a distance between the rotation axis of the first scroll plate (31) and the rotation axis of the second scroll plate (32), wherein the first scroll plate (31) is provided with a first transmission hole (31*b*) extending along an axial direction of the first scroll plate (31), and the first shaft portion (34*a*) extends into the first transmission hole (31*b*), and wherein the second scroll plate (32) is provided with a second transmission hole (32*c*) extending along an axial direction of the second scroll plate (32), and the second shaft portion (34*b*) extends into the second transmission hole (32*c*).

9. The dual-mode compressor of claim 8, wherein a number of the transmission member (34) is more than one, a plurality of first transmission holes (31*b*) are arranged uniformly along a circumferential direction of the first scroll plate (31), and a plurality of the second transmission holes (32*c*) are arranged uniformly along a circumferential direction of the second scroll plate (32).

10. The dual-mode compressor of claim 8, wherein the first shaft portion (34*a*) is in clearance fit with the first transmission hole (31*b*), and the second shaft portion (34*b*) is in clearance fit with the second transmission hole (32*c*).

11. The dual-mode compressor of claim 2, wherein the dual-mode compressor further comprises a second output flow channel that is controllably communicated with an outlet of the scroll compression working cavity (3*a*) and an outside of the dual-mode compressor, wherein the second output flow channel (11*b*) is controlled to be opened or closed.

12. The dual-mode compressor of claim 3, wherein the dual-mode compressor further comprises a second output flow channel that is controllably communicated with an outlet of the scroll compression working cavity (3*a*) and an outside of the dual-mode compressor, wherein the second output flow channel (11*b*) is controlled to be opened or closed.

13. The dual-mode compressor of claim 2 wherein the dual-mode compressor further comprises an input flow channel (11*a*) that is communicated with an inlet of the scroll compression working cavity (3*a*) and an outside of the dual-mode compressor.

14. The dual-mode compressor of claim 3, wherein the dual-mode compressor further comprises an input flow channel (11*a*) that is communicated with an inlet of the scroll compression working cavity (3*a*) and an outside of the dual-mode compressor.

15. The dual-mode compressor of claim 2, wherein the second scroll plate (32) is formed in one piece with the impeller (33).

16. The dual-mode compressor of claim 3, wherein the second scroll plate (32) is formed in one piece with the impeller (33).

17. The dual-mode compressor of claim 2, wherein each of the blades (33*a*) extends continuously from a central portion of the second scroll plate (32) to a peripheral surface of the second scroll plate (32), and each of the plurality of the centrifugal compression flow channels (33*d*) is formed as being gradually expanding from the center portion of the second scroll plate (32) toward the peripheral surface of the second scroll plate (32).

18. The dual-mode compressor of claim 3, wherein each of the blades (33*a*) extends continuously from a central portion of the second scroll plate (32) to a peripheral surface of the second scroll plate (32), and each of the plurality of the centrifugal compression flow channels (33*d*) is formed as being gradually expanding from the center portion of the second scroll plate (32) toward the peripheral surface of the second scroll plate (32).

19. The dual-mode compressor of claim 2, wherein the dual-mode compressor further comprises a transmission member (34) comprising a first shaft portion (34*a*) and a second shaft portion (34*b*) that are fixed to each other, a central axis of the first shaft portion (34*a*) is parallel to and staggered with a central axis of the second shaft portion (34*b*), and a distance between the central axis of the first shaft portion (34*a*) and the central axis of the second shaft portion (34*b*) is equal to a distance between the rotation axis of the first scroll plate (31) and the rotation axis of the second scroll plate (32), wherein the first scroll plate (31) is provided with a first transmission hole (31*b*) extending along an axial direction of the first scroll plate (31), and the first shaft portion (34*a*) extends into the first transmission hole (31*b*), and wherein the second scroll plate (32) is provided with a second transmission hole (32*c*) extending along an axial direction of the second scroll plate (32), and the second shaft portion (34*b*) extends into the second transmission hole (32*c*).

20. The dual-mode compressor of claim 3, wherein the dual-mode compressor further comprises a transmission member (34) comprising a first shaft portion (34*a*) and a second shaft portion (34*b*) that are fixed to each other, a central axis of the first shaft portion (34*a*) is parallel to and staggered with a central axis of the second shaft portion (34*b*), and a distance between the central axis of the first shaft portion (34*a*) and the central axis of the second shaft portion (34*b*) is equal to a distance between the rotation axis of the first scroll plate (31) and the rotation axis of the second scroll plate (32), wherein the first scroll plate (31) is provided with a first transmission hole (31*b*) extending along an axial direction of the first scroll plate (31), and the first shaft portion (34*a*) extends into the first transmission hole (31*b*), and wherein the second scroll plate (32) is provided with a second transmission hole (32*c*) extending along an axial direction of the second scroll plate (32), and the second shaft portion (34*b*) extends into the second transmission hole (32*c*).

* * * * *